United States Patent [19]

Rousseau

[11] Patent Number: 5,074,809

[45] Date of Patent: Dec. 24, 1991

[54] ULTRAMINIATURE HIGH-FREQUENCY CONNECTION INTERFACE

[75] Inventor: François Rousseau, Limours, France

[73] Assignee: Alliance Technique Industrielle, Evry, France

[21] Appl. No.: 545,605

[22] Filed: Jun. 29, 1990

[51] Int. Cl.[5] ..... H01R 17/04

[52] U.S. Cl. ..... 439/675; 439/578

[58] Field of Search ..... 439/180, 353, 357, 578, 439/579, 580, 581, 582, 583, 584, 585, 675

[56] References Cited

U.S. PATENT DOCUMENTS 3,445,794 5/1969 O'Keefe .

4,545,633 10/1985 McGeary ..... 439/675 X

FOREIGN PATENT DOCUMENTS 0006343 1/1980 European Pat. Off. .

2139018 10/1984 United Kingdom .

OTHER PUBLICATIONS

Microwave Journal, vol. 27, No. 3, Mar. 1984, "Ruggedized 3.5 mm Connector Contact".

*Primary Examiner*—Neil Abrams

*Assistant Examiner*—Khiem Nguyen

*Attorney, Agent, or Firm*—Dennison, Meserole, Pollack & Scheiner

[57] ABSTRACT

A connector element (1) comprises a dielectric sleeve (12) that axially accommodates a conductor (10), which may be female, and peripherally an outer conductor (16) including a rigid zone (160) followed by a nose (170), the solid beginning of which rests on a bearing surface (121) of the dielectric sleeve, while the subsequent slit portion of it terminates at an outer edge (180) provided with two chamfers connected by a flat side (183). This flat side assures electrical continuity, while the remainder of the nose (170) enables guidance and elastic retention in a homologous hole of the other connector, and the support surface (165) determines the coupling limit of the same connectors.

18 Claims, 7 Drawing Sheets

A.A 271
291
271
225
208
22
280
20
270
26c
b
a
265
Ø2
Ø1
A.A 271
2
270
20
225
A
A
26c
22

ULTRAMINIATURE HIGH-FREQUENCY CONNECTION INTERFACE

The invention relates to high-frequency connections, particularly ultrahigh-frequency or microwave connections.

These are disconnectable connections intended to make non-permanent links. Such links are used in the transmission of ultrahigh-frequency electrical signals, or in the search for an electromagnetic "shielding" effect.

The connectors in question are coaxial or even multiaxial, for example triaxial. Although the invention is generally applicable to all these types of connectors, the present description essentially addresses coaxial connectors.

It will also be recalled that such connectors may be disposed either between two coaxial cables or between a coaxial cable and a printed wiring board, or again between a coaxial cable and an ultrahigh-frequency apparatus.

To limit alteration of the signal transmitted, the connectors, like all cables, must meet certain electrical characteristics within their operating frequency band. These electrical characteristics are essentially the ratio or rate of stationary waves, the characteristic impedance, and the insertion losses.

Meeting these characteristics depends primarily on the internal geometry of the connectors and on the nature of the dielectric used and its form, in an interdependent manner.

The interface, comprising a pair of ultrahigh-frequency connectors, must accordingly assure an electrical function that in the ultrahigh-frequency band in question has continuous electrical links with respect to the internal contacts among one another, and the external contacts among one another, on the one hand, and on the other the continuous presence of one or more dielectrics between the internal contacts; the latter contacts may be connected to ground.

In general, high-frequency connection interfaces are already known that include two coupled connector elements (plugs and sockets, or more simply, connectors) of generally cylindrical shape, each having at least one central conductor and one peripheral conductor, separated by a dielectric.

In the majority of cases, the connector elements are in the form of shouldered cylinders of various diameters, wedged concentrically one inside the other, although the coaxial structure is not strictly mandatory.

In terms of the operation of coupling two connectors, it is apparent that these products must have excellent symmetry and excellent structural precision; what is in fact achieved is a double interlacing of the parts, between the internal contacts of one part and the external contacts of the other.

Various factors currently favor maximum miniaturization of ultrahigh-frequency products, and naturally of their connectors. These factors are the increasing use of ultrahigh frequency, the increasingly frequent use of high-speed digital signals, and the particular need for miniaturization in aeronautics or in space applications, for example.

Accordingly there is a perceived need for connectors, hereinafter called "ultraminiature" connectors, that is, that have an overall size on the order of magnitude of a grain of wheat.

At this level of miniaturization, new problems arise, because the difficulty in creation and construction of such products are inverse functions of their size.

These connectors must in fact have electrical qualities on the same order as those required for modern professional coaxial connectors that are of an easily manipulated size.

However, to take one example, in view of the fact that the quality of the contacts is essential in ultrahigh-frequency, and that reducing the size reduces the radius of curvature as well, this consequently increases the difficulties presented by any surface irregularity.

Reducing the size also reduces the mass of the parts and consequently lowers their possible mechanical strength as well. On the other hand, the forces brought into play during the life of the connectors or while they are coupled remains of the same magnitude. This is another source of problems.

Finally, and in the same sense, it will be appreciated that something as small as a grain of wheat is particularly difficult to manipulate, which only makes the problem discussed above more severe.

The object of the present invention is essentially to overcome this problem, by making ultrahigh-frequency connectors of very small size, typically having an overall external diameter of approximately 3 to 4 mm, or less.

In a very general characteristic of the invention, for a first connector, the outer surface of the dielectric sleeve defines a bearing surface with a stop on the side opposite the other connector, and the peripheral conductor is constructed beginning at a rigid zone engaging the bearing surface, resting on the stop on one side and on the other having a radially recessed shoulder in the form of an elastic nose, which extends beyond the bearing surface, while its end portion, which is slit, is provided at the end with an outer lateral chamfered edge; the inner wall of the peripheral conductor of the second connector includes, opposite the first connector, a first hole, arranged to receive the back of the sleeve abutting its rear portion and in the front, with the radial face of the sleeve, defining an annular recess arranged to accommodate the edge; a second hole, homologous to the slit nose; and finally an end stop, arranged to cooperate with the radial shoulder of the first connector, and associated with an inner lateral chamfer.

The interface bearing surface between the two connectors is located between the end stop of the peripheral conductor of the second connector and the radial shoulder of the peripheral conductor of the first connector. Mechanical centering is achieved by cooperation between the inner hole of the peripheral conductor of the second connector and the outer contour of the nose of the first connector, in particular in its unslit zone. Retention of the two connectors in position is effected by the cooperation in the longitudinal direction of the chamfered edge of the first connector and the annular recess of the second connector. Finally, the external electrical contact, the quality of which is essential, is assured by the cooperation of these same parts in the radial direction.

Preferably, the aforementioned edge of the peripheral conductor of the first connector includes a downstream chamfer at an angle of approximately 30°, and an upstream chamfer (oriented toward the other connector) at an angle of approximately 45°, while the mouth of the peripheral conductor of the second connector has a cylindrical precentering zone, followed by an inner downstream chamfer having an angle of approximately 30°. This makes it considerably easier to introduce the two connectors into one another.

In practice, the second connector has a central male conductor provided with a radial coupling ring arranged to press on its dielectric sleeve at the same time as it makes an adaptation of ultrahigh-frequency impedance; the first connector has a slit central female conductor, the portion of which that extends beyond the sleeve being provided with an added thickness forming a high-frequency adaptation appendage, at the same time as it provides a reinforcement, which both increases the security with which the male contact is plugged in, and yet is arranged to reach through the central opening of the dielectric sleeve of the first connector.

The proposed structure is well suited to the case where the first connector has the central female conductor. This female conductor is then accommodated in a sheath that lengthens the dielectric sleeve of the first connector, with a reduction in diameter. The bottom of the blind hole of this central conductor may be located substantially vertically of the radial shoulder of the peripheral conductor of this first connector. For its part, the central male conductor is accommodated resting on a vertical radial face of the sleeve of the second connector.

Preferably, the central conductors include homologous chamfers at an angle of approximately 45°.

It is also advantageous that the peripheral conductors protrude in length past the central conductors.

In another feature of the invention, the outer contour of the peripheral conductor may be prismatic, at least for the second connector. This characteristic, which is equally applicable to the first connector, makes manipulation and manual coupling of the two connectors considerably easier. It is not inappropriate to recall here that when two parts are put into place by hand, any difficulty in manipulation is translated into increased wasted effort, which in turn puts undue strain on the mechanical parts in question. It has been observed that for the connectors of the present invention, the characteristics described above make it possible to prevent many causes of breakage of material, which are obviously disastrous under such circumstances.

The structure that has just been defined applies particularly well to the case where the cooperating surfaces of the conductors of the two connectors have a cylindrical shape generated by coaxial revolution. However, it is equally applicable to the case of triaxial or multiaxial connectors for example.

In another very important feature of the invention, the peripheral conductor of the second connector is lengthened at its free end by an expansion having a prismatic internal contour. In this case, the rigid zone of the peripheral conductor of the first connector must have on the outside a prismatic contour coupled with the foregoing contour. This prevents any relative rotation of the two connectors, which hence provides major improvement to their resistance to vibration. However, this characteristic may also serve more generally to compensate for any torsional force between the two connectors, whether they are of the coaxial or the multiaxial type.

Further characteristics and advantages of the invention will become apparent from the ensuing detailed description and the accompanying drawings, in which:

FIGS. 1A and B, in the form of a sectional view, show a first example of a pair of connectors according to the present invention;

One skilled in the art knows that in connectors in general and quite particularly in those of the type discussed here, geometry is important. In this respect, the drawings essentially present information of a certain character. Accordingly they should be considered an integral part of this description and thus can serve not only for better understanding thereof but also contribute to the definition of the invention, as applicable.

Although the invention is not limited to this, ultraminiature coaxial connectors will now be considered which are capable of ultrahigh-frequency performance required in professional electronics. The manufacture of ultrahigh-frequency connectors in general is known to be tricky. This is all the more true if the connectors are to be ultraminiaturized.

One of the components of the problem to be solved is to obtain connectors of reduced dimensions capable of being coupled to form an interface of optimized dimensions, to enable manipulation of them.

Moreover, particularly advantageous connectors the central and peripheral conductors of which are of different genders will be described hereinafter, but the invention is also applicable when the conductors are of the same gender.

As to terminology, in the present detailed description the term "conductor" is used to define the conductive parts incorporated in the connector, although these parts are also often known as "contacts".

Figure 1A:
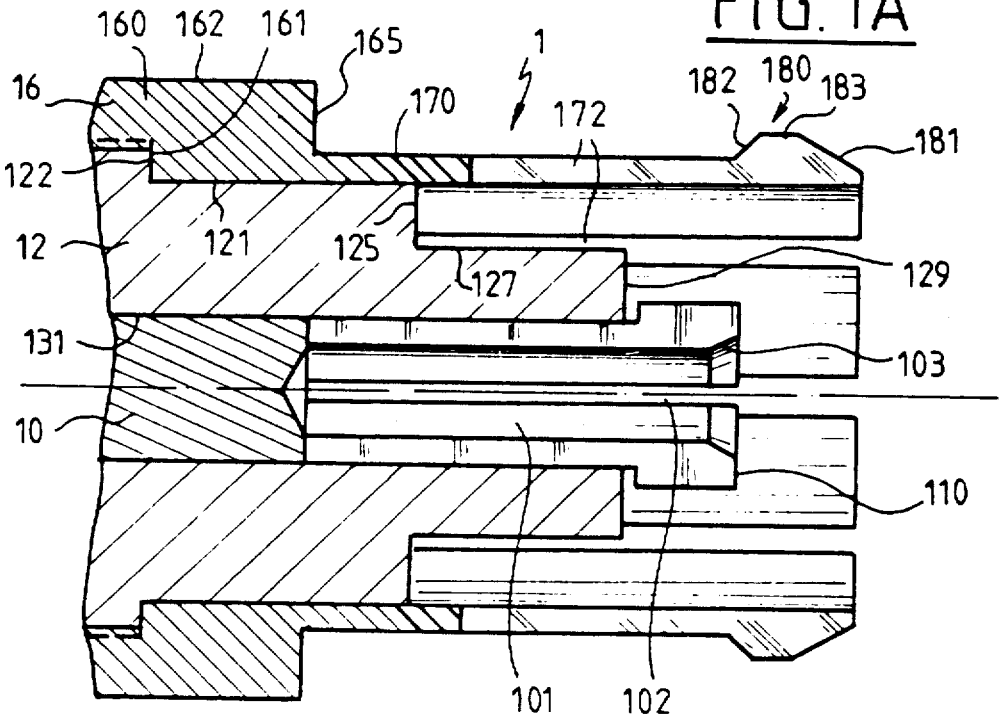
Figure 1B:
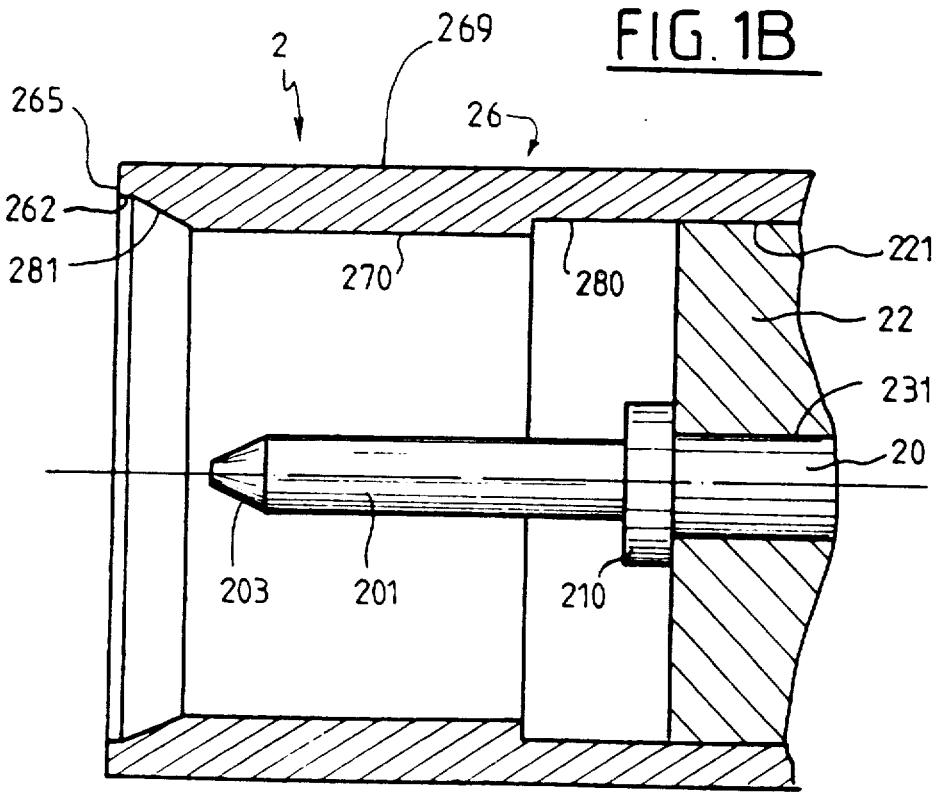

FIGS. 1A and 1B, on the one hand, and 2A and 2B on the other describe quasi-identical pairs of conductors, except for the fact that those of FIG. 2 are provided with an anti-rotation device.

These four drawings will accordingly be described together.

Reference numeral 1 indicates the connector on the left, that is, the one with its connection part facing toward the right, while reference numeral 2 designates the connector on the right, that is, the one with its connection part facing left.

For the sake of clarity in the drawing, the two connectors are not shown plugged together. However, as the fine line in the drawing shows, their position with respect to their axis of symmetry is the same as if they were plugged together. In other words, for them to be in the plugged-in position, it would suffice to move one of the connectors in translation perpendicular to its axis, until this axis coincides with that of the other connector.

The connector 1 includes a central connector generally identified by reference numeral 10, the material of which may be selected to suit what is needed. Toward the right, this connector includes a female zone 101, or hole, provided with four slits such as 102, distributed regularly over its periphery, which are parallel to the axis of the cylindrical generatrix. The hole of the central conductor ends in a chamfer 103 flared at an angle of approximately 45°. This entire central conductor is wedged into the central hole of a dielectric sleeve 12. On the outside, this sleeve has a bearing surface 121, terminated on the left by a stop 122 or protruding shoulder. Vertically of the bearing surface 121 there is a recessed shoulder 125, which ends here at a sheath 127 that extends the sleeve 12 so as to accommodate most of the female zone of the central conductor 10. Reference numeral 129 identifies the end of the sleeve on the downstream side, or in other words on the side toward the other connector.

A peripheral conductor 16 engages the outside of this sleeve. It includes a reinforced zone 160 of great thickness and is hence relatively rigid. Here, the peripheral conductor may be of heat-treated beryllium copper, gold-plated, on a nickel substrate. This material, which is elastic when thin, may become relatively rigid when it is very thick. This rigid zone 160 is provided with a shoulder 161 that comes to rest on the stop 122 of the dielectric sleeve 12. Toward the left, the conductor 16 may be held on the sleeve 12 by forceful wedging, or by the presence of fluting, or by any other technique that lends great rigidity to the assembly.

By pinching the four slits 102, the diameter of the flange 110 of the central conductor 10 can be reduced sufficiently to enable installing this conductor back-end-in, because the flange then extends across the hole 131 of the dielectric 12. This capability is very important in practice.

On the outside, the rigid zone 160 includes a surface 162 which is cylindrical, or even better prismatic, simply for the sake of easier graspability. On the right, the rigid zone ends in a recessed shoulder 165 that enables the material comprising the part 160 to now define a fine structure of generally cylindrical form leading toward the right, which will be called a "nose". In its first portion, the nose 170 is solid and rests on the bearing surface 121. As soon as it extends beyond that, it is provided with a plurality of slits distributed regularly over the circumference of the cylinder, such as the slit 172. These slits are at least four in number but it is preferred that 6 or 8 be used, to improve flexibility. Except in the slit zones, the nose 170 ends on the right at an edge 180, which matches the shape generated by revolution of the entire system. This nose 170 includes an ascending chamfer 182 on the left, that is upstream, at an angle of approximately 45°. This first chamfer is followed by a flat nose 183, followed in turn by a descending chamfer 181 at an angle of approximately 30°.

Figure 2A:
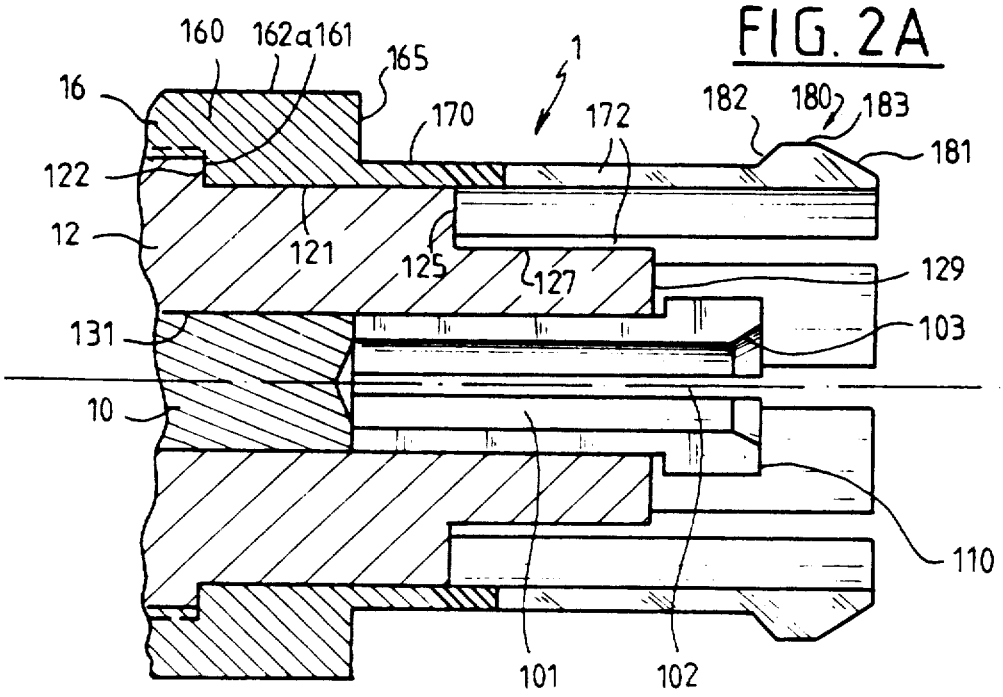
FIGS. 2A, 2B, 8A and 8B illustrate an expanded variant of the pair of connectors of FIG. 1.
Figure 2B:
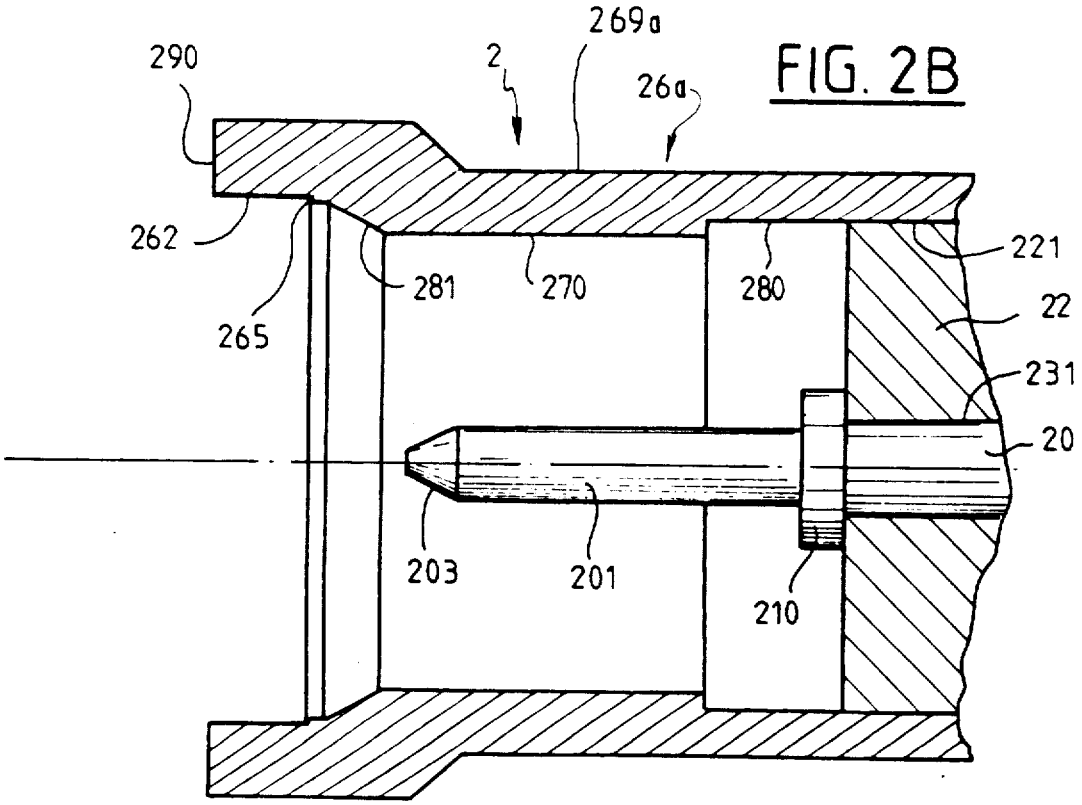

The other connector is shown in FIGS. 1B and 2B. Its dielectric sleeve is simpler (at least when the central male conductor is accommodated), since it can be reduced to a simple thin cylindrical ring, as can be seen at 22. In a central hole 231, the ring accommodates the part forming a retaining pin of the central conductor 20. The conductor includes a contact part 201 on the left, terminated by a chamfer 203 at an angle homologous to that of the chamfer 103, in other words approximately 45°.

On the outside, the peripheral conductor 26 or **26*a* is solid with the cylindrical support face 221 of the sleeve 22. Its outer surface 269 or 269*a* is cylindrical, or preferably prismatic, to improve its graspability. On the inside, this peripheral conductor 126*a* includes, first, a recess 280 close to the dielectric sleeve 22 and arranged to accommodate the aforementioned edge 180. Toward the left, there is then a hole 270, which corresponds precisely in diameter to the part 170 of the nose of the other connector. This hole ends in a recess 281 and a cylindrical precentering zone 262 or 262*a*, which precedes the stop arranged to come into contact at the homologous stop zone 165** of the other connector.

It is essentially here that the drawings in FIGS. 1B and 2B differ.

In FIG. 1B, the stop of the connector 2 is defined simply by a radial support face 265.

In FIG. 2B, this stop is defined by a small shoulder **265*a* followed by an extension 290 the inner cylindrical face 262*a*** of which is prismatic in form (the word "cylinder" is used here in its sense of mathematical geometry, applicable to any surface resting on a contour, whether the contour is curved or in the form of a broken line).

Such an embodiment in FIG. 2B requires that the part 162 of FIG. 2A be prismatic in shape, and that the prismatic shapes of this part **162*a* and of the face 262*a*** be homologous, such that after being fully engaged, the two conductors are immobilized in terms of relative rotation by these two homologous prismatic shapes.

The material comprising the peripheral conductor **126*a*** need not have elasticity. Hence machining brass, which is a good conductor and is easily machined, can be chosen, as an example.

It will be noted that in both cases, the peripheral conductor extends beyond the free end of the central conductor, which is useful particularly for the sake of mechanical protection of this central conductor.

It will also be noted that the cooperation of the left part of the hole 270 with the unslit part of the nose 170, that is, the part thereof that rests on the bearing surface 121, assures a shielding cover that lessens the escape of high-frequency radiation to the outside. It is known that in the area where the connectors are closed off from the outside, losses that impede their proper function can occur.

In the same sense, the free end of the female conductor 10 is provided with a portion 110 of added thickness, at the point where this part emerges from the sheath 127. This portion of added thickness makes it possible not only to obtain better rigidity in the zone where the wedging begins, which is important to prevent breakage, but also to assure a function as an ultrahigh-frequency adaptation appendage, which substantially improves the connection quality.

In this respect, it is advantageously combined with the flange 210 made on the central male contact 20, and this flange can likewise on the one hand serve to provide support on the radial left-hand face of face of the dielectric sleeve 22 and on the other to provide electrical adaptation of the ultrahigh-frequency link.

The importance of the interaction between the stop 265 and the shoulder 165, in order that the two connectors will rest on one another and at the same time to provide good ultrahigh-frequency insulation, has already been noted.

Mechanically, in a very simple, gentle and progressive manner, the cooperation of the hole 270 and the outer surface of the nose 170 assures excellent centering of the two connectors when they are coupled to one another. Once this coupling operation is completed, the two connectors are kept in position by cooperation of the chamfer 182 with the shoulder 280 on the left. The retention thus obtained is excellent. The other chamfer 181, in cooperation with the surfaces 282 and 281, will have served to assure the entry of the nose into the hole 270, elastically deforming the hole, which prepares for the centering, with both great flexibility and sufficient force to prevent any deformation or breakage of the component parts of the two connectors. These characteristics are quite important, considering the fact that when objects of very small size are manipulated by hand, which is always difficult, forces are often exerted that are out of proportion to what these parts can in fact withstand.

Finally, and above all, despite these difficulties, it remains possible to assure excellent electrical contact at the level of the outer conductors, by interaction between the flat cylindrical face of the recess 280 and the flat side 183 of the edge 141, this edge being stressed elastically under the influence of blades made in the nose 170, in such a way as to be capable of adapting to the peripheral conductor 26 over a maximum surface area. A study of the drawings shows that the blades comprising the nose 170 will continue to be slightly stressed elastically during connector operation.

Figure 3B:
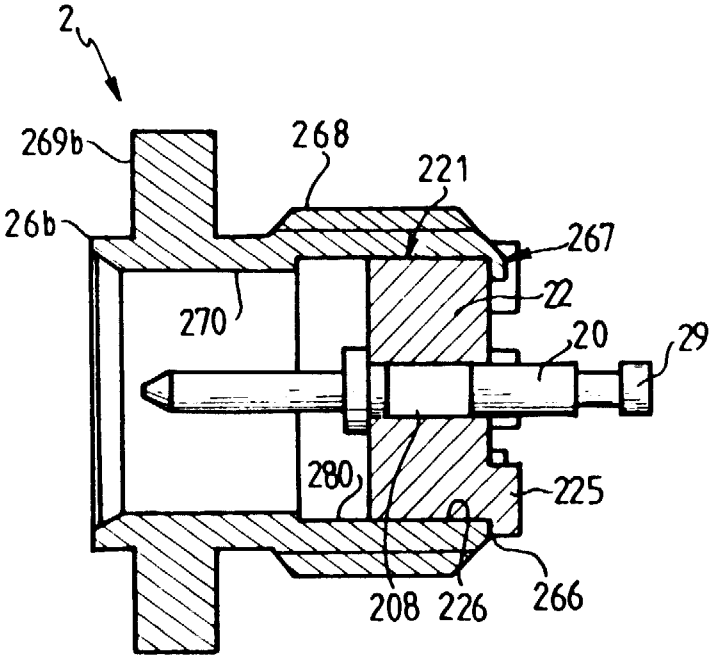
FIGS. 3A and 3B illustrate an advantageous embodiment of the second connector according to the present invention, for mounting to a chassis.
Figure 3A:
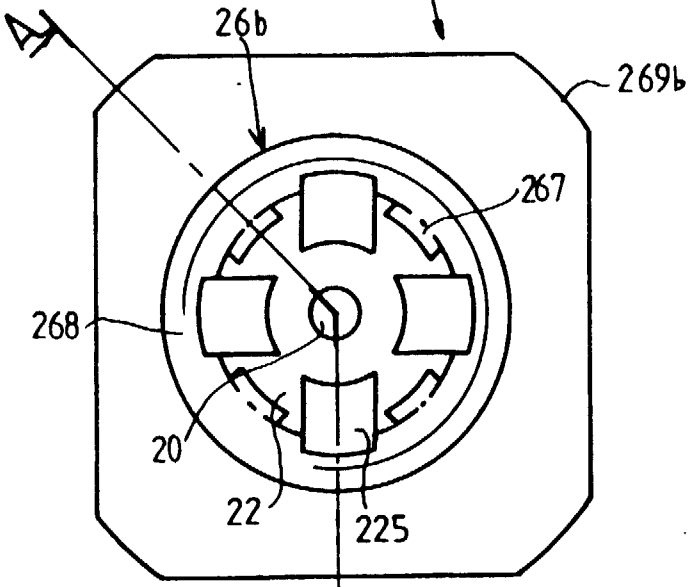

In one embodiment (FIGS. 3A and 3B), which is optionally applicable only to the second connector, the insulating sleeve 122 is advantageously molded; this enables crimping of the peripheral conductor onto it, without changing the inside diameter. Its outer surface includes ridges or longitudinal flutes, at 226, enabling it to be seated tightly in the hole 221.

At the back, the sleeve 22 has lugs 225 (four in number, for example), which abut against the rear radial face 266 of the peripheral conductor **26*b***.

Finally, this rear face 266 is provided with machined lugs 267 that are crimped onto the dielectric to immobilize it.

This arrangement leads to minimum bulk, considering the fact that because the thickness of the conductor **26*b* is so slight, it is not possible to hold the dielectric by a stop shoulder. Moreover, machining the inside of this conductor 26*b* can be done with a single tool, and hence with great precision, even for a very small diameter. Finally, the firm immobilization of the dielectric assures good dimensioning of the recess 280. The central conductor, fluted at 208, is tightly seated in the dielectric sleeve 22**.

Here, the central connection at the rear is effected on a recessed pin 29, while the outer conductor is connected to a chassis by its thread 268 and the outer stop shoulder **269*b***.

Figures 4A, 4B:
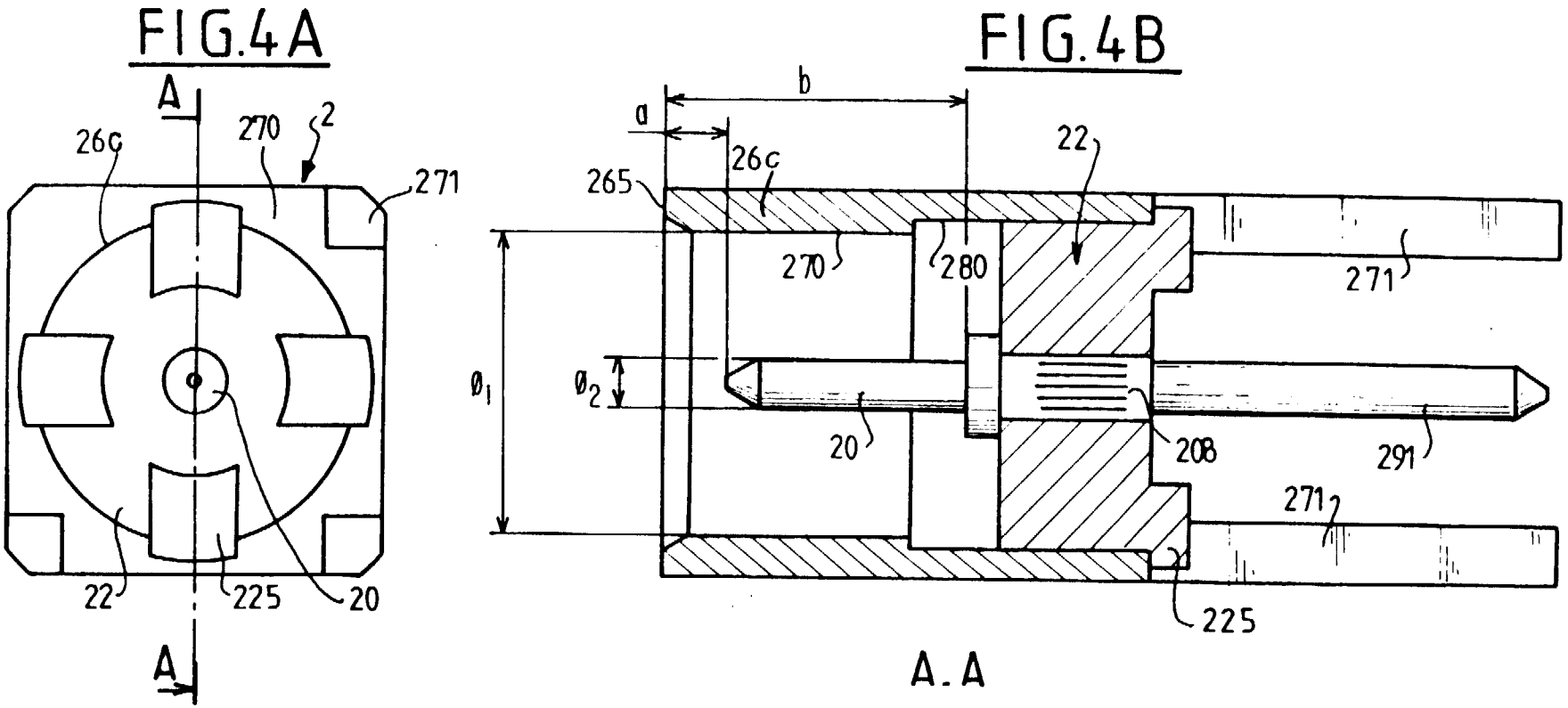
FIGS. 4A and 4B illustrate a variant for mounting on a printed circuit.

As can be seen in FIGS. 4A and 4B, the rear portion of the outer conductor **26*c* can be widened in polygonal cross section, for example square cross section, with three or more pins 271, which like the pin 291 of the central conductor are arranged for mounting on a printed circuit. In that case the lugs 267 can be omitted, because the retention of the dielectric is assured after the fixation onto the printed circuit. The remainder is similar to FIGS. 3A and 3B**.

The dimensions shown in FIG. 4B are as follows:

a) 0.40(+0.25, −0.00) mm b) 2.18 mm $\phi_1$) 2.40(+0.00, −0.04) mm $\phi_2$) 0.38 ±1.01 mm.

Figure 5:
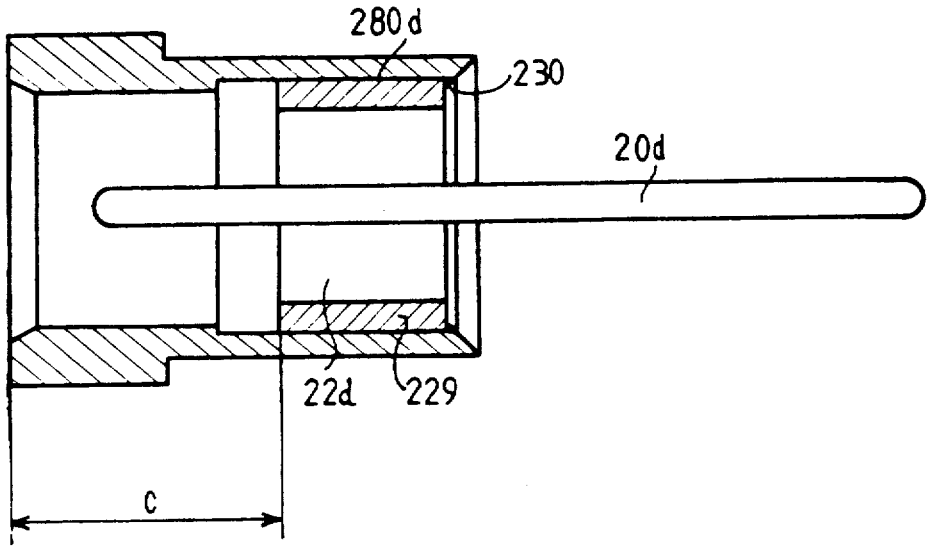
FIG. 5 illustrates another, hermetically sealed variant of the second connector.

In FIG. 5, a second connector is shown that forms a hermetically sealed unit.

As its dielectric sleeve, it uses a glass bead **22*d* preequipped with the central conductor 20*d*, and a solderable metal hoop 229 on the periphery. The hoop is inserted into the hole 280*d* with fixation in the form of a solder preform on a template affecting the hoop itself, and reinforced with a soldered zone 230** at the rear.

Another variant embodiment comprises making at least one of the conductors of a ferro-nickel alloy or of stainless steel, which is compatible with the use of a glass dielectric.

Figure 6A:
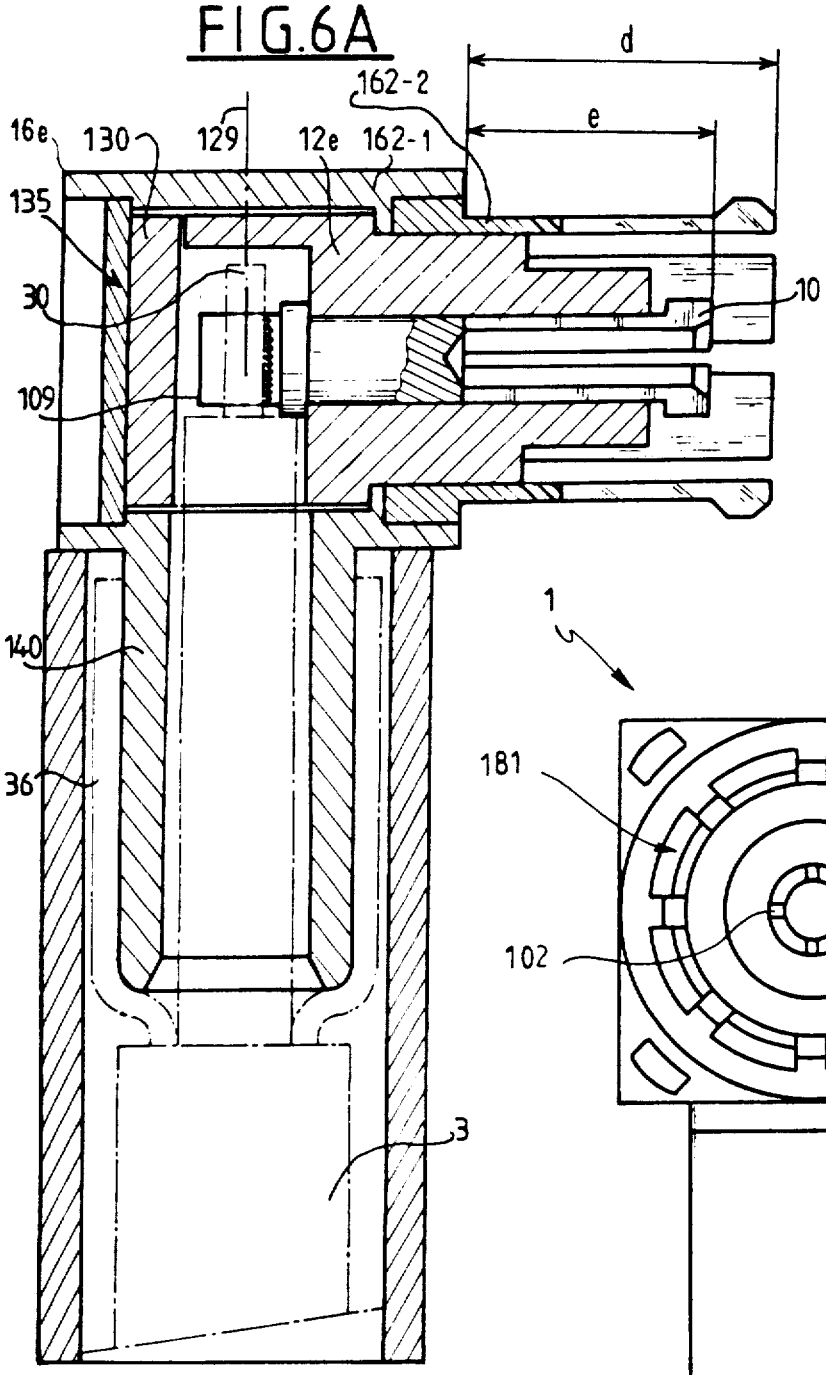
FIGS. 6A and 6B illustrate a preferred variant of the first connector.
Figure 6B:
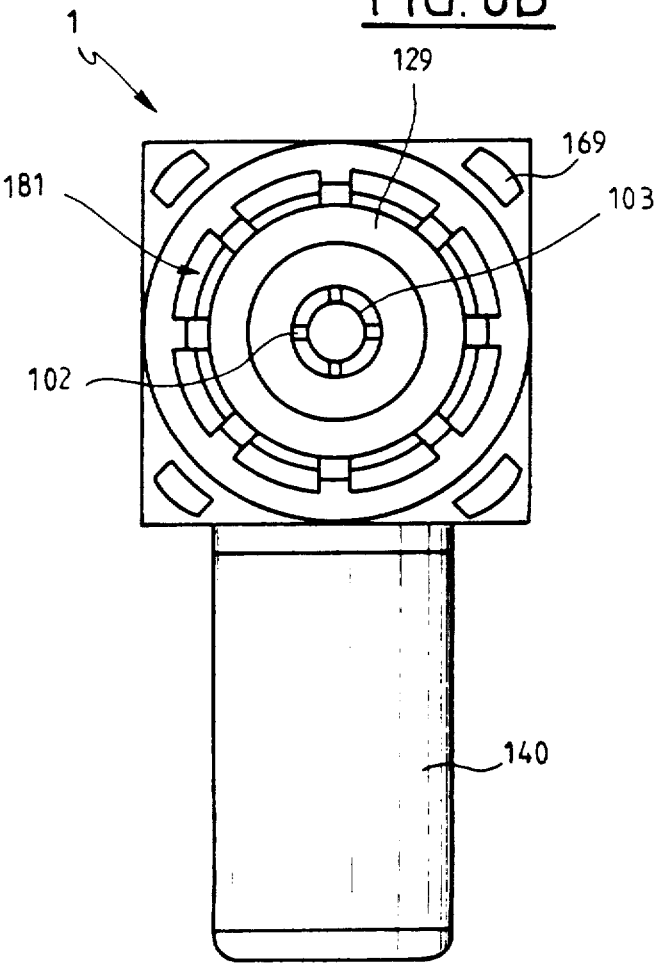

On the other hand, as can be seen in FIGS. 6A and 6B, the peripheral conductor of the first connector may be either in a single piece, or made in two pieces 162-1 and 162-2, connected for example by a tight fit and being crimped at the level of the part that defines the rigid zone. The crimping lugs 169 are provided in the corners of a square enlargement of the conductor 16.

The dimension c shown in FIG. 5 is 2.80±0.02 mm.

These FIGS. 6A and 6B also show how the connector can be made in a bent or curved manner, with a turn toward a coaxial cable, which may be crimped, or in a variant, welded.

Here, the insulator **12*e* includes an axial extension 129 that defines a cavity where the central conductor has a soldering slit 109 for the core 30 of the coaxial cable 3. The cavity is closed with a radial dielectric plate 130, retained by soldering a metal lid 135 to the back of the body of the outer conductor 16*e***.

This body can be extended laterally by an embossed sleeve 140 over which the braiding 36 of the cable 3 extends. An outer metal cylinder 49 enables crimping of this braiding 36 onto the checkered sleeve 140. In FIG. 6A, dimension d is 2.60±0.03 mm and dimension e is 2.15(+0.00, −0.25) mm.

Figure 7:
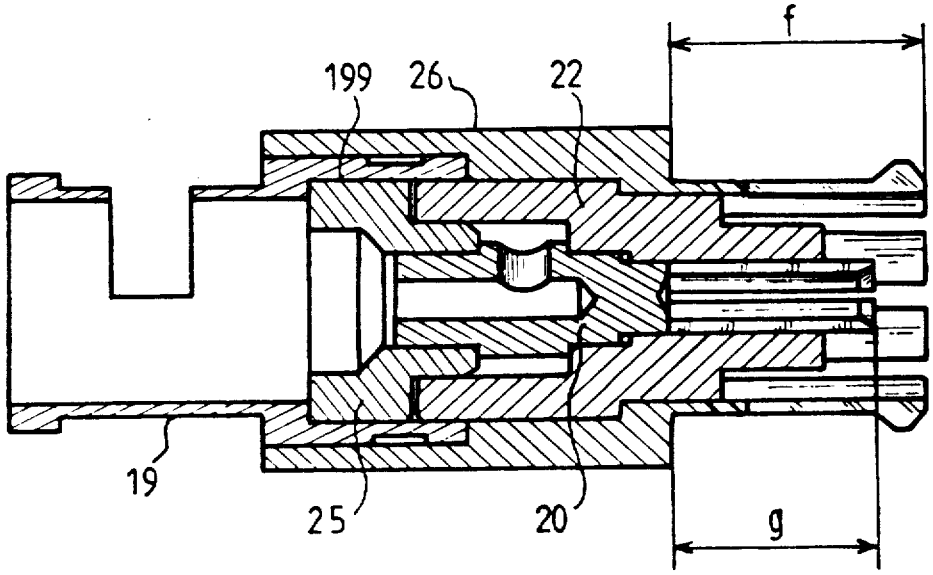
FIG. 7 illustrates another variant of the first connector.

The variant in FIG. 7 shows a first connector in a straight (rather than bent) version.

The back of the central conductor 20 defines a housing with lateral access for welding the core of a coaxial cable. This rear portion is retained by a dielectric ring 25 resting on the outside both on the dielectric 22 and on the internal hole 199 of a cylinder 19 for welding (or crimping) the braiding. Factory preassembly of the elements 19, 199 and 20 makes installation of the coaxial cable considerably easier for the user. It will be noted that the female (or male) plug thus constituted lengthens a coaxial cable having the dimensions of FIG. 6B practically without increasing its thickness.

In FIG. 7, dimension f is 2.60±0.03 mm and dimension g is 2.15(+0.00, −0.25) mm.

More generally, connecting the connectors according to the invention by the back end can be the subject of several variants, each of them applicable to each connector element:

- connection via soldered pins in the holes of printed wiring boards,
- connection by soldered leads on the surface of printed wiring boards (known as surface mounted devices or SMDs),
- connection on printed wiring boards or ultrahigh-frequency equipment by a flexible circuit technology known as "strip line",
- connection to flexible coaxial cables,
- connection to semi-rigid coaxial cables, and
- connection forming a body with an active or passive, ultrahigh-frequency device such as an antenna, a resonant cavity or a transition between an ultrahigh-frequency waveguide and a coaxial cable.

As already indicated above, it is particularly tricky to make ultraminiature connectors that both function with satisfaction, given the existing constraints in the ultrahigh-frequency field, and can be made at a reasonable cost.

The solutions advocated in the present invention have enabled Applicant to make a range of connectors for the above applications, the nominal dimensions of which enable them to be absolutely interchangeable.

Figure 8A:
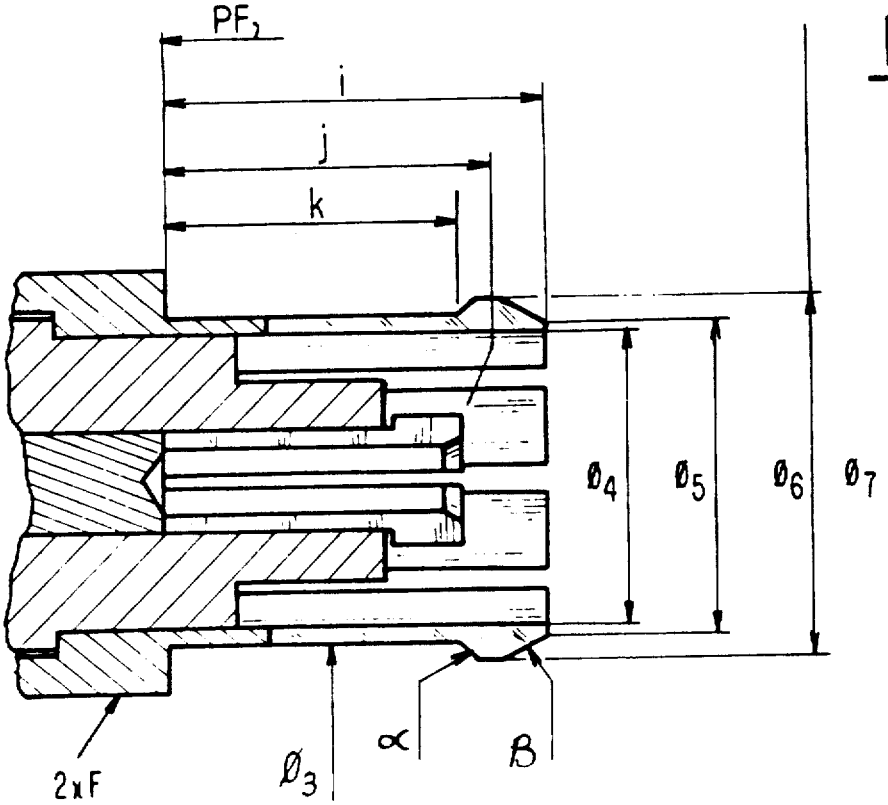
Figure 8B:
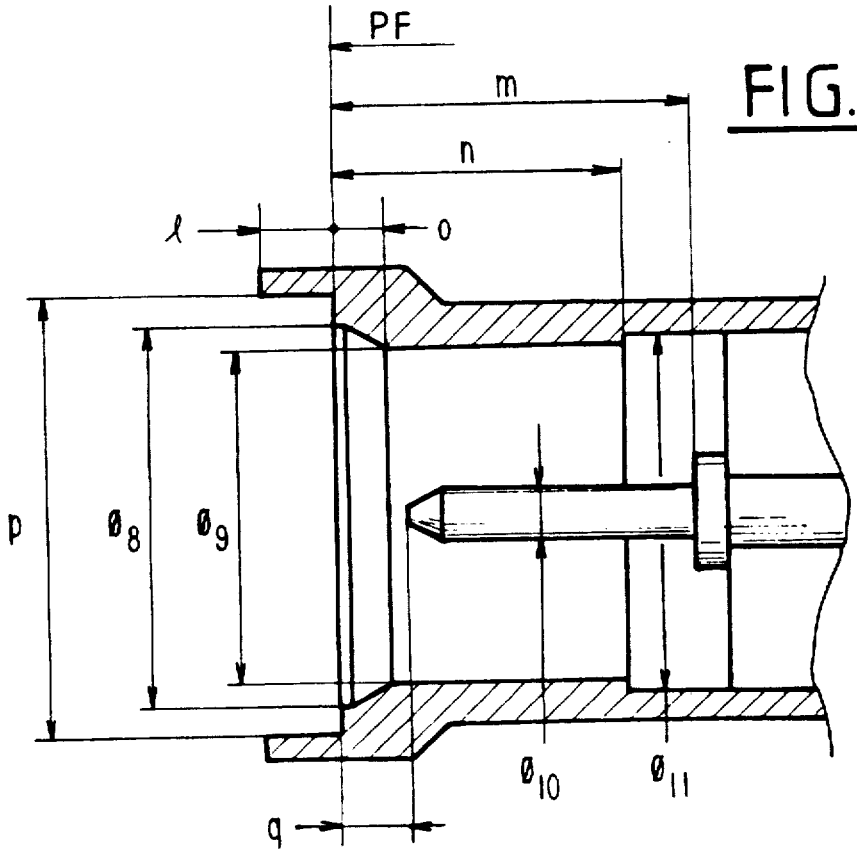

FIGS. 8A and 8B, respectively, show the active portion of a connector of the first type and a connector of the second type according to the present invention, with an indication of the dimensions and applicable tolerances for such a connector.

In these figures, PF designates the reference plane of the interface once the connector is connected, that is, the plane of contact of the two connector elements. A certain number of essential dimensions are shown in this plane of reference. All the dimensions are expressed in millimeters, while the tolerances are expressed in hundredths of a millimeter.

The dimensions marked with an asterisk refer to the variant of FIGS. 2A and 2B. They express that fact that the outer circumference of the first connector (FIG. 8A) has flat sides, two in number (2 x F), and having a minimum height of 0.6; these flat sides are capable of cooperation with the opening of a dimension 3.20 shown in FIG. 8B.

Moreover, with respect to FIG. 8A, the invention makes it possible to obtain all the dimensions desired directly in the machining phase. There is one exception, however, which concerns making the nose. In effect, as FIG. 8A shows, the nose is machined with an outer dimension of 2.55 mm. It is then filed into a cone in order to be reopened to the nominal size of 2.70 mm. A similar operation may optionally be performed for the central female contact, but in the opposite direction, that is, by making a crimp of this contact at its mouth, rather than a reopening.

Under the conditions indicated above, the constituent elements of FIGS. 8A and 8B are to be considered an integral part of the invention.

The dimensions shown in FIGS. 8A and 8B are as follows:

i) 2.60±0.03 mm
j) 2.15(+0.00, −0.25) mm
k) 2.00±0.05 mm
l) 0.50±0.05 mm
m) 2.18 mm
n) 1.97±0.02 mm
o) 0.35±0.05 mm
p) 3.20(+0.05, −0.00) mm
q) 0.40(+0.25, −0.00) mm
$\phi_3$) 2.3(+0.4, −0.0) mm
$\phi_4$) 2.05(+0.03, −0.00) mm
$\phi_5$) 2.20(+0.02, −0.00) mm
$\phi_6$) 2.55(+0.00, −0.03) mm
$\phi_7$) 2.70±0.05 mm
$\phi_8$) 2.70±0.02 mm
$\phi_9$) 2.40(+0.00, −0.04) mm
$\phi_{10}$) 0.38±0.01 mm
$\phi_{11}$) 2.55±0.02 mm
$\alpha=45°$ $\beta=30°$.

I claim:

1. Ultraminiature high frequency connection interface, comprising two coupled connector elements (1, 2) of generally cylindrical form, each having a dielectric sleeve (12, 22) carrying at least one central conductor (10, 20) and a peripheral conductor, a first said connector element (1) comprising said dielectric sleeve (12) having a central orifice (131) and an outer bearing surface (121) with a radially disposed stop (122) on a connector portion away from and facing the other connector, the peripheral conductor (16) comprising a rigid zone (160) engaging said bearing surface (121) and resting on said stop in the direction away from the other connector, said rigid zone further comprising a radially recessed shoulder (165) facing the other connector, said peripheral conductor (16) having and elastic nose portion (170) extending toward the other connector and beyond said bearing surface, the end portion of said elastic nose being slit (172) and provided with an outer lateral chamfered edge (180), said first connector element further comprising a central conductor (10) fitted in said central orifice (131) and having a slit central female sleeve (101) with a portion of increased thickness (110) extending beyond said dielectric sleeve (12) and forming a high frequency adaptation appendage and a reinforcement for securing a second connector element, and a second said connector element (2) comprising said peripheral conductor (26) including first and second contiguous bores, said first bore (221) disposed away from the first connector and arranged to receive a second dielectric sleeve (22) abutting the rear portion of said first bore, the radial face of the sleeve and the first bore defining an annular recess (280) receiving said chamferd edge (180), said second bore (270) having a smaller internal diameter than said first bore and disposed, relative to the first bore, in the direction toward the first connector, said second bore being homologous to said slit nose portion, said peripheral conductor (26) further comprising an end stop having an inner lateral chamfer (281) arranged to cooperate with the radial shoulder (165) of said first connector, said second connector further comprising a central male conductor (20) having a radial coupling ring (210) arranged to press on said dielectric sleeve (22) simultaneously with making an adaptation of ultra high frequency impedance.

2. The interface as defined by claim 1, characterized in that said edge (180) of the peripheral conductor (16) of the first connector includes a downstream chamfer (181) at an angle of approximately 30°, and an upstream chamfer (182) at an angle of approximately 45°, while the mouth of the peripheral conductor (26) of the second connector has a cylindrical precentering zone (262), followed by an inner chamfer at an angle of approximately 30°.

3. The interface as defined by one of claims 1 or 2, characterized in that the first connector (1) carries the central female conductor, accommodated in a sheath (129) extending its sleeve but with a reduced diameter, the bottom of this conductor being substantially vertical of said radial shoulder (165), while the central male conductor (20) is accommodated resting on said radial vertical face of the sleeve (22) of the second conductor.

4. The interface as defined by one of claims 1 or 2, characterized in that the central conductors (10, 20) include homologous chamfers at an angle of approximately 45°.

5. The interface as defined by one of claims 1 or 2 characterized in that the peripheral conductors (16, 26) protrude in length past the central conductors (10, 20).

6. The interface as defined by one of claims 1 or 2, characterized in that the outer contour of the peripheral conductor (26) of the second connector is prismatic.

7. The interface as defined by one of claims 1 or 2, characterized in that the peripheral conductor (16) of the first connector is provided with at least four slits (172), regularly distributed.

8. The interface as defined by claim 7, characterized in that the peripheral conductor of the first connector is provided with six slits.

9. The interface as defined by one of claims, characterized in that the cooperating surfaces of the conductors of the two connectors have a cylindrical shape generated by coaxial revolution.

10. The interface as defined by claim 9, characterized in that the peripheral conductor (26) of the second connector is lengthened at its free end by an expansion (290) having a prismatic internal contour (262), and that the rigid zone (162) of the peripheral conductor (16) of the first connector has a prismatic contour on the outside coupled with the foregoing contour, which prevents any relative rotation of the two connectors.

11. The interface as defined by one of claims 1 or 2, characterized in that the end zone of the second bore (270) of the second connector, after assembly, reaches the unslit portion (170) of the nose of the first connector, thereby averting high-frequency leaks at the level of the outer junction between the two connectors.

12. The interface as defined by one of claims, characterized in that the peripheral conductor (16) of the first connector is of an elastic material.

13. The interface as defined by claim 12, characterized in that the elastic material is gold-plated beryllium copper on a nickel substrate.

14. The interface as defined by one of claims 1 or 2, characterized in that the peripheral conductor (26) of the second connector is of a material of low ductility that is easily machined.

15. The interface as defined by claim 14, characterized in that the second connector is made of machining brass.

16. The interface as defined by one of claims 1 or 2, characterized in that the dielectric sleeve (22) of the second connector is made by molding, with external fluting, enabling its tight seating inside the peripheral conductor (26).

17. The interface as defined by one of claims 1 or 2, characterized in that the dielectric sleeve (22) of the second connector is made in the form of a glass bead, provided beforehand with the central male conductor (20) which is premolded with it, and equipped on the outside with a metal hoop (229) suitable for tight seating with the peripheral conductor (26), and immobilizable in it b soldering at the back.

18. The interface as defined by one of claims 1 or 2, characterized in that its overall outer dimensions are on the order of 3 to 4 mm.

* * * * *